United States Patent [19]

Fieschi

[11] Patent Number: 4,892,047

[45] Date of Patent: Jan. 9, 1990

[54] SEWING MACHINE FOR FEEDING AND CUTTING RIBBON LIKE PIECES OF DIFFERENT WIDTHS

[75] Inventor: Giorgio Fieschi, Buccinasco - Milan, Italy

[73] Assignee: Rockwell-Rimoldi, S.p.A., Olcella, Italy

[21] Appl. No.: 218,716

[22] Filed: Jul. 13, 1988

[30] Foreign Application Priority Data

Oct. 9, 1987 [IT] Italy ..... 22209 A/87

[51] Int. Cl.[4] ..... D05B 35/10; D05B 37/04

[52] U.S. Cl. ..... 112/122; 112/152; 112/126

[58] Field of Search ..... 112/152, 122, 126, 129, 112/130, 235

[56] References Cited

U.S. PATENT DOCUMENTS

| | | | |
|---|---|---|---|
| 1,195,767 | 8/1916 | Berger | 112/152 X |
| 2,706,456 | 4/1955 | Strangler | 112/152 |
| 3,149,589 | 9/1964 | Fowler, Sr. | 112/130 X |
| 4,024,824 | 5/1977 | Haff, Jr. | 112/152 X |

FOREIGN PATENT DOCUMENTS

| | | | |
|---|---|---|---|
| 2209238 | 8/1973 | Fed. Rep. of Germany | 112/130 |

*Primary Examiner*—Andrew M. Falik

*Attorney, Agent, or Firm*—Laff, Whitesel, Conte & Saret

[57] ABSTRACT

A sewing machine includes a presser foot 9 provided, at the front portion 9a thereof, with an engagement seat 21 through which two ribbon-like pieces of trimmings 15, 16 of different width to be individually and selectively fed to the presser foot, can be sent under a central portion 9b of the latter so that they are engaged by the line of sewing together with the workpiece. An adjustment element 23 is positioned in said engagement seat in order to define the useful width of the seat depending upon the width of the piece of trimmings to be used. A cutting unit 31 is slidably mounted along a guide element 34 and is movable from a rest position in which it is spaced apart sideways from the sewing machine supporting table 3 to a rest position in which it is located close to the supporting table to cut the piece of trimmings previously used.

2 Claims, 1 Drawing Sheet

SEWING MACHINE FOR FEEDING AND CUTTING RIBBON LIKE PIECES OF DIFFERENT WIDTHS

BACKGROUND OF THE INVENTION

1. Field of the Invention

The present invention relates to a sewing machine of the type comprising a bed defining a workpiece supporting table along which a workpiece is caused to move; a presser foot acting upon the workpiece to push it towards the supporting table; sewing means acting through the supporting table in the region of said presser foot in order to sew the workpiece; feed means to feed the presser foot with at least a ribbon-like piece of trimmings during the execution of stitching; an engagement seat formed in a front portion of the presser foot and arranged to guide the piece of trimmings under the presser foot through a slit extending transversely to the shoe; and cutting means to cut the piece of trimmings upstream of the presser foot.

The sewing machine of the invention is particularly adapted to be used when garments consisting of several component parts to be assembled together and to which it may be necessary to add elastic bands, support tapes and the like of different widths, have to be manufactured.

2. Prior Art

It is known that there are sewing machines capable of joining elastic bands, tapes or other types of trimmings to a workpiece as the latter is being sewn.

To this end these sewing machines are comprised of a presser foot which is provided, at the front portion thereof, with an engagement seat terminating in a slit extending transversely to the presser foot shoe, in front of a central portion of the presser foot itself. The ribbon-like trimmings to be engaged with the stitching are first wound to form a roll and during the stitching are submitted to the action of feed means which gradually unwinds them and sends them to the engagement seat. So the piece of trimmings engages in the seat and is thereby guided under the central portion of the presser foot, in which region the stitching takes place.

Provision is also made for a cutting unit fastened to the sewing machine bed so as to be disposed before the presser foot in a raised position with respect to the same. The cutting unit acts upon the piece of trimmings moving towards the presser foot in order to cut it at the appropriate time.

Sewing machines of the above type have some drawbacks as regards their practicality in use and versatility. In greater detail, it is to be noted that the fixed positioning of the cutting unit in front of the machine presser foot often hinders the movements performed by an operator when he is handling a workpiece. For the above reason it is better to resort to the sewing machines of the type in reference exclusively when trimmings have to be applied during the stitching, whereas conventional sewing machines devoid of said feed means and cutting unit are used when normal stitchings are concerned, that is when there is no need to add trimmings. Furthermore, in the machines of the known art the engagement seat in the presser foot has a substantially fixed width so that it is hardly adapted to apply trimmings having different widths. In other words, it is impossible to use the same presser foot to sew trimmings, for example elastic bands, to the waist and sleeves of garments which necessarily have different widths.

On the contrary, when the width of a piece of trimmings to be applied is different from that of the trimmings applied before, the presser foot must be replaced or another machine suitably arranged with an appropriate presser foot must be used.

In conclusion, at the present state of the art it is always necessary to use two or more sewing machines when a workpiece consisting of several parts and provided with ribbon-like trimmings must be manufactured.

SUMMARY OF THE INVENTION

It is an object of the present invention to solve the above mentioned problems by providing a sewing machine which is capable of carrying out stitchings with the addition of ribbon-like trimmings of different widths and which at the same time can be used to make conventional sewings to assemble pieces while ensuring an excellent practicality in use.

The foregoing and further objects which will become more apparent in the course of the following description are substantially attained by a sewing machine comprising the combination of a presser foot provided with an engagement seat of an adjustable width and of cutting means, which cutting means consists of a cutting unit slidably mounted along at least a guide element fastened to the bed and positioning means acting on the cutting unit to move it along the guide element from a rest position in which the cutting unit is spaced apart sideways from the supporting table to a working position in which the cutting unit is disposed adjacent the supporting table and before the presser foot to perform the cutting of the piece of trimmings.

BRIEF DESCRIPTION OF THE DRAWINGS

Further features and advantages will best be understood from the detailed description of a preferred embodiment of a sewing machine in accordance with the invention, given hereinafter by way of non-limiting example with reference to the accompanying drawings, in which.

DESCRIPTION OF THE PREFERRED EMBODIMENT

Figure 1:
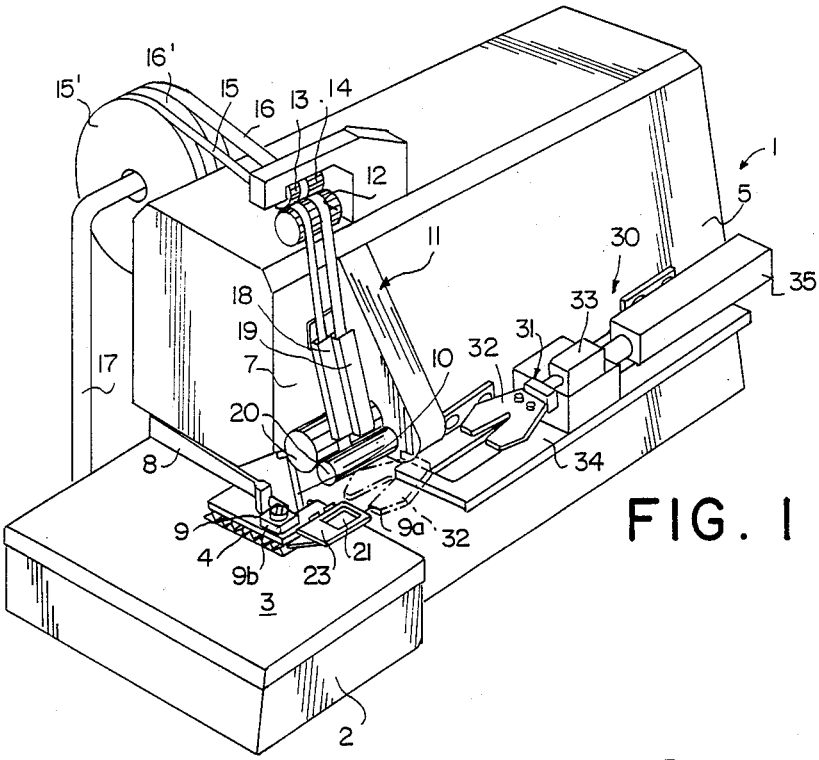
FIG. 1 is a front perspective view of the sewing machine in accordance with the invention.
Figure 3:
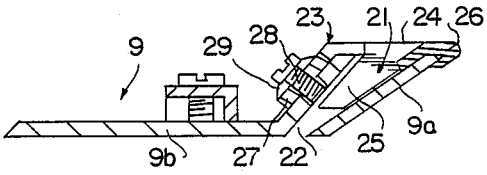
FIG. 3 is a sectional view taken along line III—III in FIG. 2.

Referring to the drawings, a sewing machine in accordance with the present invention has been globally identified by reference numeral 1.

In known manner the sewing machine 1 comprises a bed 2 defining a workpiece supporting table 3 where feed dogs 4 are located which in operation cause the workpiece to move forward on the supporting table itself. Raising from the machine bed 2, alongside the supporting table 2, is a standard 5 supporting a head 7 located above the supporting table 3 in cantilevered fashion.

Housed in the head 7 is a presser foot holder 8 supporting a presser foot 9 at the lower part thereof; said presser foot substantially acts so as to urge the workpiece towards the supporting table 3 and particularly towards the feed dogs 4, due to the spring action exerted by said presser foot holder. Also operatively engaged in the head 7 is a needle bar provided with a reciprocating movement substantially in a vertical direction and equipped at the lower part thereof with at least a needle 10 acting through the workpiece and the supporting table to carry out stitchings in cooperation with other sewing means.

The sewing machine 1 further comprises feed means 11 adapted to send at least a ribbon-like piece of trimmings to the presser foot 9. Said feed means comprises a pulling roller 12 which in known manner is rotationally moved in synchronism with the forward movement of the workpiece on the supporting table 3. First and second pressing rollers 13, 14 are associated with the pulling roller 12 and they can be individually and selectively operated in known manner to push first and second ribbon-like trimmings, 15 and 16 respectively, against the pulling roller.

Said trimmings 15, 16 which are first wound to form respective rollers 15' and 16' rotatably supported by at least a bracket 17, are designed to pass respectively through a first guide 18 and a second guide 19 fastened to the front portion of head 7 and are then engaged by feed rollers 20 directing them towards the presser foot 9.

An engagement seat 21 is provided on the front portion 9*a* of presser foot 9 and it is designed to individually and selectively engage the trimmings 15 and 16 in order to guide them under a central portion 9*b* of said presser foot through a slit extending transversely to the presser foot shoe.

In an original manner at least one of the engagement seat walls consists of an adjustment element 23 adapted to be positioned transversely to the presser foot 9 to define the width of said engagement seat depending upon the width of trimmings 15, 16 to be used. In greater detail, the adjustment element 23 comprises a grasping portion 24 from which a boundary tab 25 defining a side wall of the engagement seat 21, extends. On either side of the grasping portion 24 there are also two extensions 26 and 27 disposed parallelly to each other, the former being a guide extension extending astride of the front wall of the engagement seat 21 and the latter being a connecting extension 27 disposed alongside a rear wall of said engagement seat. The connecting extension 27 has a longitudinal slot 27*a* slidably crossed by one or more screws 28 operatively engaging with the rear wall of seat 21. Interposed between the head of each screw 28 and the connecting extension 27 is at least a dish spring 29 which exerts a thrust action on the connecting extension.

The sewing machine 1 further comprises cutting means 30 designed to cut the piece of trimmings 15 or 16 at the end of stitching.

Said cutting means is comprised of a cutting unit 31 substantially consisting of shears 32 actuated by a fluid-operated cylinder 33 and acting on trimmings 15 or 16 in front of the presser foot 9 and downstream of the feed rollers 20.

In an original manner the cutting unit 31 is slidably mounted on at least a guide element 34 fixed with respect to the machine bed 2 and extending parallelly to the standard 5. The cutting unit 31 is interlocked to positioning means consisting for example of a fluid-operated cylinder 35 fastened to the guide element 34 and acting so as to move the cutting unit from a rest position in which, as shown in FIG. 1, it is spaced apart sideways with respect to the supporting table 3, to a working position in which the cutting unit is disposed adjacent the supporting table and in front of the presser foot 9 to carry out the cutting of trimmings 15, 16.

Operation of the sewing machine according to the invention described above mainly as regards structure, is as follows.

When the cutting unit 31 is in its rest position, it cannot hinder the movements the operator must perform in the region of head 7 in order to suitably guide the workpiece during the execution of a stitching. Under this situation the sewing machine 1 can advantageously be used for normal stitchings that is when trimmings are not applied. During this work step trimmings are arranged in engagement relationship on the pulling roller 12 and in the respective guides 18 and 19. The pulling roller 12 and feed rollers 20 are kept in an inactive condition.

Figure 2:
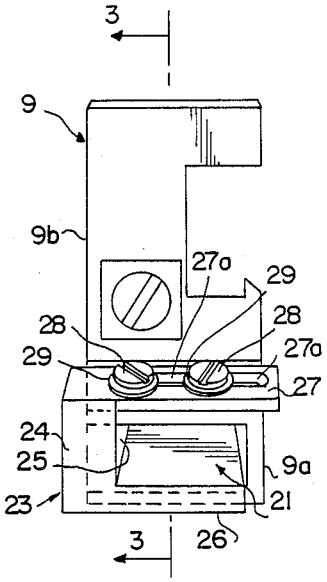
FIG. 2 is a top view to an enlarged scale of the presser foot studied for the sewing machine in reference.

Upon completion of said working step on a given number of workpieces, when it is necessary to apply the first piece of trimmings 15 to the workpieces, said piece is first manually engaged between the feed rollers 20 and in the engagement seat 21 to be guided beneath the presser foot 9. The adjustment element 23 has been previously arranged to make the engagement seat 21 substantially correspond with the width of the first piece of trimmings 15. If the piece of trimmings 15 has a reduced width, as shown in FIG. 2, the adjustment element 23 will be moved towards the right. During the execution of the line of stitching the first pressing roller 13 is thrusted against the pulling roller 12 in known manner to cause the unwinding of the ribbon-like piece 15 from roller 15*a*. Said ribbon 15, after passing through the respective guide 18, feed rollers 20 and engagement seat 21, is engaged by the line of stitching when it is under the central portion 9*b* of the presser foot 9.

At the end of stitching, the fluid-operated cylinder 35 is actuated and it moves the cutting unit 31 along the guide element 34 to bring said unit to its working position for the purpose of cutting the first ribbon 15 upon command of the fluid-operated cylinder 33.

Said fluid-operated cylinder 35 can be actuated directly by the operator through known electronic control means.

When the first ribbon 15 has been applied to a given number of workpieces, it may be necessary to apply a second type of ribbon-like trimmings 16 having a greater width than the first type. To this end the adjustment element 23 is moved to the left with reference to FIG. 2 so that the width of the engagement seat 21 may be adapted to the width of the second trimmings 16. The movement of the adjustment element 23 is carried out manually overcoming the frictional resistance due to the action of dish springs 29 on the connecting portion 27.

After the disengagement of the first trimmings 15 from feed rollers 20, the second trimmings 16 are engaged with the same rollers and in the engagement seat 21 so as to be brought under the presser foot 9. In the same manner as stated above with reference to the first trimmings 15, during the sewing the second trimmings 16 are kept in contact with the pulling roller 12 upon the action of the second pressing roller 14 so that a piece of trimmings can be gradually unwound from roller 16' and engaged with the line of stitching in the region of the presser foot 9. Also the cutting of the second trimmings 16 by the cutting unit 31 takes place in the same manner as previously described with reference to the first trimmings 15.

The present invention attains the intended purposes.

In fact when the cutting unit is in its rest position, that is spaced apart sideways from the supporting table 3, the operator is able to move freely and consequently the sewing machine can be used not only to perform seams involving the application of trimmings, but also to sew the component parts of the workpiece together.

In addition, due to the particular presser foot structure and to the presence of the adjustment element 23, it is possible to apply ribbon-like trimmings of different widths using the same sewing machine.

Therefore thanks to the present invention it is possible to manufacture fnished products consisting of several parts assembled by stitching and provided with trimmings, such as elastic bands, tapes and the like, of different widths without resorting to the use of several sewing machines, which on the contrary happens with the machines of the known art.

Obviously the present invention is susceptible of many modifications and variations, all falling within the scope of the inventive idea characterizing it.

What is claimed is:

1. A sewing machine for feeding and cutting ribbon-like pieces of different widths comprising a presser foot having an engagement seat in a front portion of the presser foot for guiding said ribbon-like pieces under said presser foot through a slit extending downwardly from said engagement seat, feed means for feeding said ribbon-like pieces to said engagement seat, and cutting means for cutting pieces of trimmings between said feed means and said engagement seat, said presser foot having an adjusting element slidably carried in a region of said engagement seat, said adjusting element being provided with a boundary tab extending inside of said engagement seat for defining the width of the engagement seat depending upon the ribbon-like trimming width; said cutting means having a cutting unit slidably mounted on a guide means carried by said sewing machine, and positioning means for moving said cutting unit from a rest position spaced apart sideways from said engagement seat to a cutting position disposed in front of said engagement seat wherein when said cutting unit is positioned by said positioning means in the cutting position, an operating cylinder of said cutting unit is actuated and it further moves forward a shear means for carryng out a cutting operation on ribbon-like trimming and, vice-versa, when said cutting operation has been completed by said cylinder, said positioning means returning said cutting unit to said rest position away from said engagement seat.

2. A sewing machine as claimed in claim 1 wherein said adjustment element comprises a grasping portion from which said boundary tab extends and a connecting extension extending adjacent a wall of the engagement seat and exhibiting a longitudinal slot slidably engaged by at least a screw member, and at least a dish spring being interposed between a threaded member and said connecting extension.

* * * * *